US008122665B2

(12) United States Patent
Stanchfield et al.

(10) Patent No.: US 8,122,665 B2
(45) **Date of Patent: *Feb. 28, 2012**

(54) BREAK-AWAY MULTI-PURPOSE FLOORING TRANSITION

(75) Inventors: Oliver Stanchfield, Garner, NC (US); Sven Kornfalt, Malmo (SE); Roland Larsson, Apex, NC (US); William T. Pierce, Smithfield, NC (US); Sabad La Serna, Raleigh, NC (US); Patrick George Smith, Raleigh, NC (US); Wayne Robert Johnston, San Marcos, CA (US)

(73) Assignee: Pergo (Europe) AG, Trelleborg (SE)

( * ) Notice: Subject to any disclaimer, the term of this patent is extended or adjusted under 35 U.S.C. 154(b) by 768 days.

This patent is subject to a terminal disclaimer.

(21) Appl. No.: 11/655,885

(22) Filed: Jan. 22, 2007

(65) Prior Publication Data

US 2008/0034700 A1 Feb. 14, 2008

Related U.S. Application Data

(60) Provisional application No. 60/808,121, filed on May 25, 2006.

(51) Int. Cl.
*E04D 1/36* (2006.01)

(52) U.S. Cl. ..... 52/468; 52/464; 52/466; 52/716.4

(58) Field of Classification Search ..... 52/716.3, 52/716.4, 717.01, 718.01, 464, 466, 468
See application file for complete search history.

(56) References Cited

U.S. PATENT DOCUMENTS

| | | | | |
|---|---|---|---|---|
| 3,411,977 | A | 11/1968 | Slater, Jr. | |
| 3,543,326 | A * | 12/1970 | Rohrberg et al. | 16/16 |
| 3,696,461 | A * | 10/1972 | Kelly | 16/16 |
| 4,244,102 | A | 1/1981 | Bolles | |
| 4,833,956 | A | 5/1989 | Roberts | |
| 4,893,449 | A * | 1/1990 | Kemper | 52/464 |
| 5,657,598 | A * | 8/1997 | Wilbs et al. | 52/287.1 |
| 6,230,385 | B1 * | 5/2001 | Nelson | 29/450 |
| 6,230,410 | B1 | 5/2001 | Taylor et al. | |
| 6,298,561 | B1 | 10/2001 | Decker | |
| 6,345,480 | B1 * | 2/2002 | Kemper et al. | 52/395 |
| 6,517,935 | B1 | 2/2003 | Kornfalt | |
| 6,536,178 | B1 * | 3/2003 | Pålsson et al. | 52/589.1 |
| 6,550,192 | B1 * | 4/2003 | Nelson et al. | 52/177 |

(Continued)

FOREIGN PATENT DOCUMENTS

WO 9731775 9/1997

(Continued)

OTHER PUBLICATIONS

International Search Report.

*Primary Examiner* — William Gilbert
*Assistant Examiner* — Alp Akbasli
(74) *Attorney, Agent, or Firm* — Novack Druce + Quigg LLP

(57) ABSTRACT

The invention is a joint cover assembly for covering a gap adjacent an edge of a panel that covers a sub-surface, and a method of covering such a gap. The assembly can be manipulated to form an end molding, a T-molding, a hard surface reducer, a carpet reducer, and/or a stair nose molding.

7 Claims, 7 Drawing Sheets

U.S. PATENT DOCUMENTS

| | | | | |
|---|---|---|---|---|
| 6,550,205 | B2 * | 4/2003 | Neuhofer, Jr. | 52/464 |
| 6,588,165 | B1 * | 7/2003 | Wright | 52/506.05 |
| 6,591,568 | B1 * | 7/2003 | Pålsson | 52/592.2 |
| 6,805,951 | B2 | 10/2004 | Kornfalt | |
| 6,823,638 | B2 * | 11/2004 | Stanchfield | 52/588.1 |
| 6,860,074 | B2 * | 3/2005 | Stanchfield | 52/464 |
| 6,898,911 | B2 | 5/2005 | Kornfalt | |
| 6,964,075 | B1 | 11/2005 | Iannacone, Jr. | |
| 6,991,830 | B1 | 1/2006 | Hansson | |
| 7,003,364 | B1 | 2/2006 | Hansson | |
| 7,029,741 | B2 | 4/2006 | Sjoberg | |
| 7,065,931 | B2 | 6/2006 | Kornfalt | |
| 7,207,143 | B2 * | 4/2007 | Stanchfield | 52/459 |
| D542,939 | S * | 5/2007 | Neuhofer, Jr. | D25/136 |
| D542,941 | S * | 5/2007 | Neuhofer, Jr. | D25/136 |
| 7,287,357 | B2 * | 10/2007 | Gomez Insa | 52/464 |
| 7,814,720 | B2 * | 10/2010 | Neuhofer | 52/471 |
| 7,908,819 | B2 * | 3/2011 | Neuhofer, Jr. | 52/747.1 |
| 2002/0038924 | A1 | 4/2002 | Nilsson et al. | |
| 2003/0084634 | A1 * | 5/2003 | Stanchfield | 52/464 |
| 2003/0118812 | A1 * | 6/2003 | Kornfalt et al. | 428/331 |
| 2003/0141004 | A1 | 7/2003 | Palmblad et al. | |
| 2003/0154678 | A1 * | 8/2003 | Stanchfield | 52/468 |
| 2003/0159389 | A1 * | 8/2003 | Kornfalt et al. | 52/396.04 |
| 2003/0207083 | A1 | 11/2003 | Hansson et al. | |
| 2004/0206038 | A1 * | 10/2004 | Stanchfield | 52/582.1 |
| 2005/0003149 | A1 * | 1/2005 | Kornfalt et al. | 428/120 |
| 2005/0166526 | A1 | 8/2005 | Stanchfield | |
| 2006/0201093 | A1 | 9/2006 | Stanchfield | |
| 2006/0260241 | A1 | 11/2006 | Stanchfield | |

FOREIGN PATENT DOCUMENTS

| | | | |
|---|---|---|---|
| WO | 9731776 | | 9/1997 |
| WO | 0240809 | | 5/2002 |
| WO | WO 2005/083196 | * | 9/2005 |

* cited by examiner

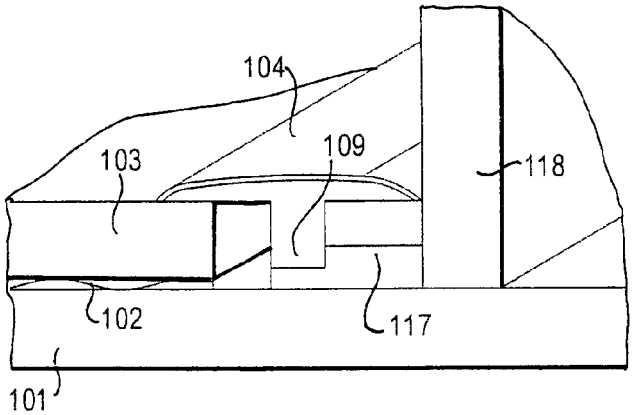
FIG. 14
FIG. 15
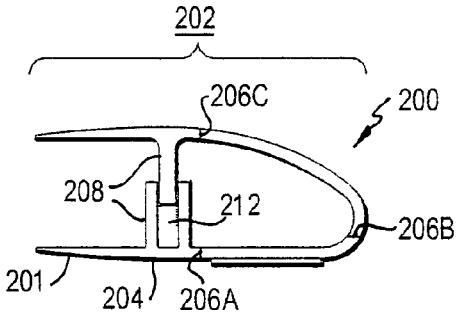
FIG. 16
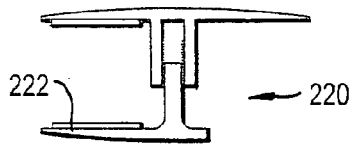
FIG. 17
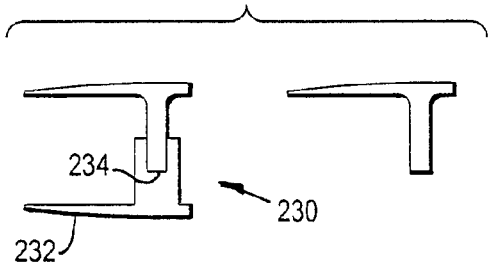
FIG. 18
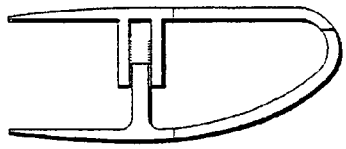
FIG. 19
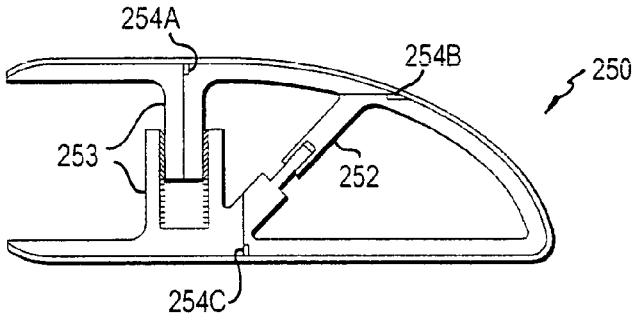

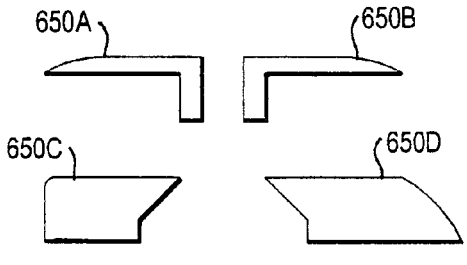
FIG. 35
FIG. 36
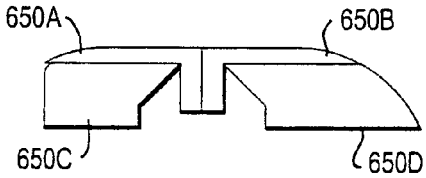
FIG. 37
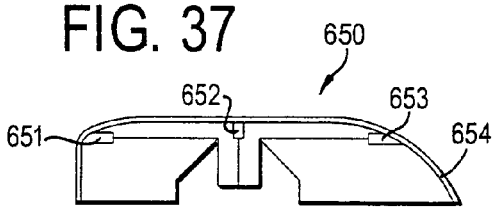
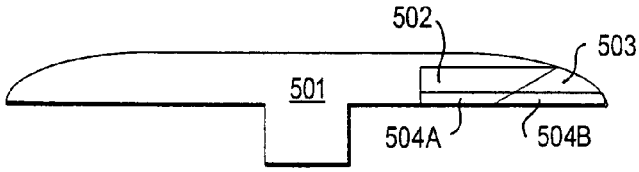
FIG. 38
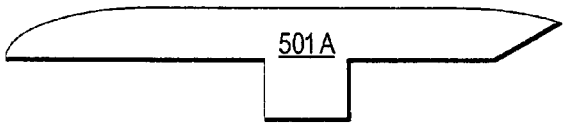
FIG. 39
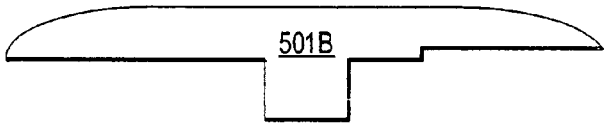
FIG. 40
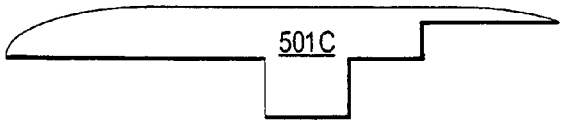
FIG. 41

BREAK-AWAY MULTI-PURPOSE FLOORING TRANSITION

BACKGROUND

1. Field of the Invention

The invention is an integral multi-purpose structure which can be separated into various flooring transitions such as T-moldings, hard surface reducers and end moldings.

2. Background of the Invention

Hard surface floors, such as wood or laminate flooring, have become increasingly popular. As such, many different types of this flooring have been developed. Generally, this type of flooring is assembled by providing a plurality of similar panels. The differing types of panels that have developed, of course, may have differing widths and thicknesses. The same is true when a laminate floor (often referred to as a "floating floor") abuts another hard surface, such as a resilient surface (such as vinyl), tile or another laminate surface, a ceramic surface, or other surface, e.g., natural or engineered wood flooring. Thus, when laminate panels having different thicknesses or different floor covering materials are placed adjacent to a similar or dissimilar, transition moldings are often used to create a transition between the same.

Additionally, one may desire to install floor panels adjacent to an area with different types of material. For example, one may desire to have one type of flooring in a kitchen (e.g., resilient flooring, laminate flooring or ceramic tile), and a different appearance in an adjacent dining room (e.g., solid wood or carpeting), and an entirely different look in an adjacent bath. Therefore, it has become necessary to develop a type of molding or floorstrip that could be used as a transition from one type of flooring to another, either between rooms, or different portions of the same room.

A problem is encountered, however, when flooring materials that are dissimilar in shape or texture are used. For example, when a hard floor is placed adjacent a carpet, problems are encountered with conventional edge moldings placed therebetween. Such problems include difficulty in covering the gap that may be formed between the floorings having different height, thickness or texture.

Moreover, for purposes of reducing cost, it is desirable to be able to have a molding that is versatile, having the ability to cover gaps between relatively coplanar surfaces, as well as surfaces of differing thicknesses.

It would also be of benefit to reduce the number of molding profiles that need to be kept in inventory by a seller or installer of laminate flooring. Thus, the invention also provides a method by which the number of moldings can be reduced while still providing all the functions necessary of different styles of transition moldings.

SUMMARY OF THE INVENTION

The invention is a joint cover assembly for covering a gap between edges of adjacent floor elements, such as floor panels of laminate or wood, although it may also be used as a transition between a laminate panel and another type of flooring, e.g., carpet, vinyl, ceramic, and wood. The assembly typically includes a body having a foot positioned along a longitudinal axis, and a first arm or member extending generally perpendicularly from the foot. The assembly may include a second arm also extending generally perpendicular from the foot.

The outward-facing surface of the assembly may be formed as a single, unitary, monolithic surface that covers both the first and second arms. This outward-facing surface may be decorated, for example, with a laminate or a paper, such as a monochromatic or patterned décor, impregnated with a resin, in order to increase its aesthetic value, to match, blend or contrast with the floor panels. Preferably, the outward facing surface has incorporated therein at least one material to increase its abrasion resistance, such as at least one type of hard particles of silica, alumina, diamond, silicon nitride, aluminum oxide, silicon carbide and similar hard particles, preferably having a Moh's hardness of at least approximately 6. This outward-facing surface may also be covered with other types of coverings, such as cork, foils (such as paper or thermoplastic foils), paints, papers (optionally stainable), polyurethane (optionally cured), printable surfaces, fiber glass, glass fiber reinforced plastics, or a variety of other decorative elements, including, but not limited to, wood veneer, ceramic (such as tiles), metal, vinyl or other decorative materials.

The assembly is preferably provided with a securing means, such as a clamp or track, to prevent the assembly from moving out of position once assembled. In one embodiment, the securing means is a clamp, designed to grab the foot. Preferably, the clamp includes a groove into which the foot is inserted. In a preferred embodiment, the clamp or track may be joined directly to a subsurface below the floor element, such as a subfloor, by any conventional means, such as a nail, screw or adhesive.

A shim may also be placed between the foot and the subfloor to provide for height adjustments to allow the assembly to be used in various situations. In one embodiment, the shim may be positioned on the underside of the clamp; however, if a clamp is not used, the shim may be positioned between the foot and the subfloor. The shim may be adhered to either the foot or subfloor using an adhesive or a conventional fastener, e.g., nail or screw.

The assembly is typically formed from one of a variety of materials, such as a core covered with carpet, laminate, ceramic or wood tile, linoleum, turf, metal, paper, natural wood or wood veneer, vinyl, ceramic or composite finish, or any type of surface covering, while the core is generally formed from wood, fiberboard, such as high density fiberboard (HDF) or medium density fiberboard (MDF), flaxboard, plastics, or other structural material, such as metals (e.g., aluminum, copper, brass, alloys thereof and stainless steel) or composites, and at least over a portion of the surface thereof may be covered with a foil (metal, plastic, etc.), cork, a plastic, a paper, a décor or a laminate to match or contrast with the first and second arms, or other materials, such as those discussed by U.S. Pat. No. 6,860,074, herein incorporated by reference in its entirety. Preferred plastics include extrudable and/or moldable thermosetting and thermoplastic resins, the latter including high density olefins and PVC.

The assembly may additionally be used to cover gaps between tongue-and-groove type panels, such as glued or glueless laminate floor panels, or even other types of flooring which are secured to a subsurface.

An adhesive, such as a glue, a microballoon adhesive, contact adhesive, or chemically activated adhesive, including a water-activated adhesive, may be also positioned on any of the pieces of the assembly to either hold the assembly together or in place. Of course, such an adhesive is not necessary, but may enhance or supplement the fit and positioning of the assembly over the gap between the floor elements. Additionally, the adhesive may assist in creating a more airtight or moisture-tight joint.

The assembly may be used in other non-coplanar areas, such as the edge between a wall and a floor, or even between the run and rise of stairs. For example, the assembly may include the first and second arms, and foot as described above, but instead of transitioning between two floor elements placed in the same plane, may form the joint between the horizontal and vertical surfaces of a single stair element.

The inventive assembly may be used for positioning between adjacent tongue-and-groove panels; in this regard, the assembly functions as a transition molding, which provides a cover for edges of similar or dissimilar surfaces. For example, when installing floors in a home, the assembly could be used to provide an edge between a hallway and a bedroom, between a kitchen and living or bathroom, or any areas where distinct flooring is desired. Additionally, the assembly may be incorporated into differing types of flooring, such as wood, tile, linoleum, cork, carpet, or turf.

The invention also is drawn to an inventive method for covering a gap between adjacent panels of a generally planar surface. The method includes multiple steps, including, inter alia, manipulating a generic element by removing a part of the generic element to produce one or more moldings, and thereafter, installing the moldings where needed.

The invention additionally includes a new and innovative securing means used to install both the inventive moldings as described herein, as well as other moldings, such as those described by U.S. Pat. Nos. 6,517,935, and 6,898,911, and WO0240809 (each of which is herein incorporated by reference in its entirety). This securing means is, most often, a track or clamp which can be glued, or otherwise secured to a subfloor and/or one or more flooring elements.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 14 shows an installed end molding in accordance with the invention.

FIG. 15 depicts a breakaway combination hard surface reducer/carpet reducer in accordance with the invention.

FIG. 16 shows another T-molding embodiment formed from the combination of FIG. 15.

FIG. 17 is an end molding formed from the combination of FIG. 15.

FIG. 18 represents a carpet transition formed from the combination of FIG. 15.

FIG. 19 represents an embodiment similar to the combination of FIG. 15.

FIGS. 35-37 show elements of the generic molding of the invention, indicating a construction method.

FIGS. 38-41 show additional embodiments of the generic molding of the invention, and products produced therefrom.

DETAILED DESCRIPTION OF THE PREFERRED EMBODIMENTS

Figure 1:
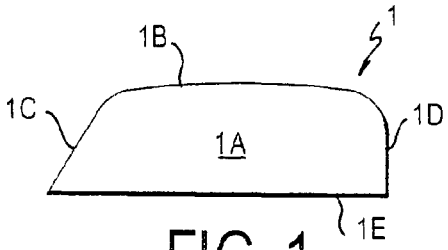
FIG. 1 is a side-view of a structure from which the moldings of the invention can be made.

FIG. 1 shows a structure 1, from which the present invention can be formed. Structure 1 typically has a core 1A, an upper face 1B, a first lateral face 1C, a second lateral face 1D and a lower face 1E.

Preferably, core 1A is formed from a fiberboard, such as high-density fiberboard (HDF) or medium-density fiberboard (MDF), plastic, metal, composites, gypsum, high-density fiber reinforced plaster, or other natural or synthetic material such as cork, or any additional material, such as described in U.S. Pat. No. 6,860,074, herein incorporated by reference in its entirety. Preferred plastics include extrudable thermoset and thermoplastic resins, the latter including high density olefins and polyvinylchloride.

The decorative outer face can have a variety of finishes, such as varnishes, lacquers, paints, polyurethane, hard surfaces (optionally containing hard particles, to increase the durability, e.g., abrasion and scratch resistance, of the surface materials), such as laminates (such as taught by U.S. application Ser. No. 10/902,062, herein incorporated by reference in its entirety), or hardwood flooring finishes, veneers, foils, stainable papers, or digital printing or other flooring materials, such as vinyl, metal, composites or plastics or natural materials such as cork. It is additionally within the scope of the invention to provide the decorative outer face of quarter round 6 with ceramic or wood tiles, as taught by U.S. Pat. No. 6,860,074. Typical laminates which can be used are those taught by U.S. Pat. No. 6,517,935 (herein incorporated by reference in its entirety), including monochromatic or patterned (including random) décor sheets which may or may not be impregnated with a thermosetting resin, and a cellulosic overlay paper, such as one made from α-cellulose, which also may or may not be impregnated with a resin. Other laminates include ones in which the overlay is eliminated, and may be substituted by a polymer containing cellulosic particles, evenly or randomly distributed throughout a (typically otherwise clear) resin. The outer surface may be a conventional laminate, such as a high pressure laminate (HPL), direct laminate (DL), compact laminate (CPL) or a post-formable laminate (as described in U.S. application Ser. No. 08/817,391, herein incorporated by reference in its entirety); a foil; a print, such as a photograph or a digitally generated image; or a liquid coating including, for example, aluminum oxide. Thus, in the event natural wood or wood veneer is not selected as the material, the appearance of wood may be simulated by coating the decorative outer surface with a laminate having a decor that simulates wood. Alternatively, the decor can simulate marble, ceramic, terrazzo, stone, brick, inlays, or even fantasy patterns.

In a preferred embodiment, the decorative face or surface includes a laminate formed from a thermosetting resin, having a décor sheet, optionally an overlay layer (with or without cellulosic fibers atop or therein) or sheet and hard particles therein in order to impart an abrasion resistance thereto, which is affixed or joined to the remainder of the quarter round 6 in a high-pressure laminate process step. Such laminate may be affixed as described by U.S. Pat. No. 6,805,951, herein incorporated by reference in its entirety. The outer face can be other finishing materials such as thermoplastic containing laminates, wood veneers, thermosetting polymers, such as melamine or phenolic resins, thermoplastic polymers such as olefins, foils (such as thermosetting, thermoplastic, paper or metal foils), optionally impregnated with or without hard particles, polyesters, vinyls, metals (such as sheets or strips), or combinations thereof. For example, the outer face can include multiple elements, as described herein. It is additionally considered within the scope of the invention to affix a material to the outer face during a direct lamination step, as is known in the art.

Often, the outer face is provided with a patterned paper sheet therein, wherein the pattern resembles a natural or synthetic object, such as wood, ceramic, stone (including marble and granite), or fantasy patterns (i.e., those not found in nature), including a monochromatic or random field. The specific décor can be selected to enhance the appearance of the surfaces which will be adjacent to quarter round 6 when installed. Such enhancement can be accomplished by matching exactly the visual pattern to that of the adjacent surface, or by contrasting the patterns, for example, such that when installed, a visual pattern extends from a flooring element (wall base or wall), onto and possibly completely across, the molding, as described by U.S. application Ser. No. 09/964,838, filed Sep. 28, 2001, herein incorporated by reference in its entirety.

The moldings of the invention typically have a durability rating. As defined by the European Producers of Laminate Flooring, such products can have an abrasion resistance rating of anywhere from AC1 to AC5. Typical abrasion resistances are >300 cycles, >400 cycles, >500 cycles, at least 900 cycles (AC1), at least 1800 cycles (AC2), at least 2500 cycles (AC3), at least 4000 cycles (AC4) and at least 6500 cycles (AC5), as measured by European Standard EN 13329 (Annex E). Typical products according to the invention can also have impact resistance ratings of IC1, IC2 or IC3, as measured by European Standard EN 13329.

Moreover, it is possible to provide a texture which enhances the pattern of the underlying paper sheet. Such texturing can be created to be "in register" with, offset from, or to contrast with the image of the paper sheet. Such texturing may be created by physical pressing, e.g., embossing (as taught by U.S. application Ser. No. 10/440,317 (filed May 19, 2003), U.S. Pat. No. 7,003,364, and WO9731775 and WO9731776, each of which is herein incorporated by reference in its entirety) or chemically created (as taught by U.S. Pat. No. 6,991,830, herein incorporated by reference in its entirety). The texture can be selected to enhance (e.g., match or contrast with) any texture of adjacent surfaces. The texture may also be provided such that features of the texture extend from a flooring element (or wall base or wall) onto, and possibly completely across, the molding, which texture may, or may not coincide with the underlying décor.

Although core 1A is shown as being a single unitary structure without any joints or connections therein, it is considered within the scope of the invention to form core 1A by joining two or more separate elements. Such separate structures need not be of the same material(s), and may be joined by, for example, by friction joints, tongue-and-groove joints, compression joints, glue, adhesive strip, double-sided tape, or any combination thereof. Although FIG. 1 shows core 1A as being solid, it is additionally considered within the scope of the invention to utilize a hollow structure, optionally with one or more supports or reinforcements provided in the interior thereof, or a composite core, incorporating an interlayer of a softer and/or resilient material, e.g., balsa or other relatively soft wood, plastic, rubber, paper, or foamed materials, in combination with a wood-fiber layer. Such an interlayer is optionally positioned in locations to facilitate removal, such as by peeling, to form the desired shapes of the invention.

Figure 2:
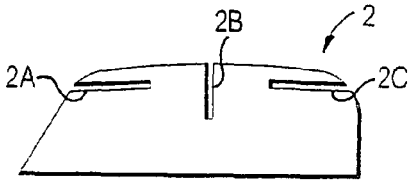
FIGS. 2, 3 and 4 are side-views of intermediate elements which can be used in the construction of the molding of the invention.
Figure 7:
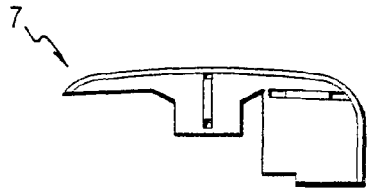
FIG. 7 is a side-view of one carpet reducer embodiment formed from the generic element of FIG. 5.
Figure 3:
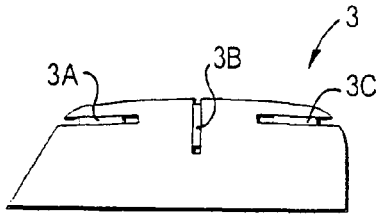
Figure 8:
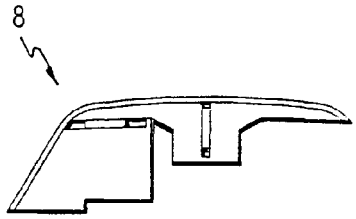
FIG. 8 is a side-view of a hard surface reducer formed from the generic element of FIG. 5.

In order to achieve the generic molding of the invention, preferably, structure 1 is provided with one or more cuts 2. Such cuts 2 can be created by milling or cutting with, for example, a blade or even a laser, on or into core 1A of structure 1. Alternatively, however, it is possible to create structure 1 with cuts 2 already therein, by, for example, an extrusion or other molding process. The particular location and number of cuts 2 are selected based upon the final shapes to be created, as will be described below. Preferably, however, structure 1 is provided with a first cut 2A in face 1C, a second cut 2B in upper face 1B, and a third cut 2C in face 1D, with no cuts in lower face 1E, as is shown in FIG. 2. Lower face 1E may be provided with a groove, which groove can be sized and shaped to accommodate for heads of screws used to affix the securing elements to the subfloor.

Known lasers include gas lasers (e.g., $CO_2$, CO, HeNe, argon), having a power output of between 5 and 100 W, up to 100 kW, preferably 20-60 W, and more preferably approximately 30 W, having a wavelength in the range of 5 μm-550 nm, typically 7-15 μm or 450-550 nm. Other known lasers include metal ion lasers (e.g., HeAg and NeCu), having wavelengths between 220 and 250 nm, chemical lasers (e.g., HF and Deuterium flouride), having wavelengths between 2700 and 4000 nm, excimer, solid state, semiconductor (e.g., Nd:YAG) and dye lasers. However, the parameters of any laser used to produce a cut should be selected depending upon, in part, on issues such as the material to be cut, the depth and/or length of the cut. The cutting laser can be part of a flying optic machine—where the cutting laser moves over the structure to be cut, although it is considered within the scope of the invention to process the workpiece by moving the workpiece with respect to the cutting laser.

Typically, cuts 2 penetrate the respective face 1B-D, but do not make a separate piece from parts of structure 1. Depending on the material used for core 1A as well as the desired force necessary, as will be described below, the depth of cuts 2 can vary greatly. If, however, covering 4A (as described below) is strong enough, it is possible for one or more cuts 2 to separate a part of structure 1. It is also within the scope of the invention to form cuts 2 such that a frangible connection is made between various sections of structure 1.

In a preferred embodiment, filler material, such as shims 3A-C are inserted into cuts 2A-C, respectively. Shims 3 preferably have a width slightly smaller than the width of the respective cut 3A-C. As a result, shims 3 typically fit snugly in the cut 3. Although no particular length for shims 3 is required, it is preferable that shims 3 are substantially shorter than the length of the respective cut 2, which cut can have differing dimensions across its length and/or width. Such may be accomplished by using tools, e.g., blades and lasers, of different dimensions. Although cuts 2 and shims 3 are shown as all being of the same shape/dimensions, it is within the scope of the present invention to vary the size, shape and dimensions of the respective cut/shim combination. Although it is preferred that shims 3 are manually or mechanically inserted into the respective cut 2, and pushed inside cut 2, it is possible to provide shims 3 having a length greater than the depth of the respective cut 2, and after insertion, remove any portion outside cut 2, and optionally a small section to provide an opening for a cutting blade, as described below. It is additionally possible to use shims 3 which have a smaller width, in combination with an adhesive or sealant to maintain shim 3 in position. If, however, cut 2 is sufficiently small, it is possible to eliminate the need for shim 3.

The material for shims 3 is preferably an olefin, polyester, or other moldable and/or extrudable thermoplastic or thermosetting material such as vinyl; solid or engineered wood or other cellulosic material, or metal. It is additionally within the scope of the invention to provide the material for shims 3 in a flowable form, which sets, hardens or dries into a solid form. The material may also be expandable, such as by foaming or by heating or chemical reaction, such that after expansion, the material substantially fills the respective cut 2. In preferred embodiments, the material for shims 3 is substantially incompressible, once set/hardened/dried.

In an alternate embodiment, the interlayer (as previously described) is positioned in alignment with the cuts 2, such that removal of the various sections is easily accomplished once the covering 4A is cut, sliced, scored, etc. In one embodiment, the interlayer allows for the sections to be peeled away. In another embodiment, the interlayer is provided with a notch therein, to facilitate easy separation from the remainder of the generic element 5; however, it is considered within the scope of the invention to provide an interlayer without any notch, which notch can be formed during the slicing, cutting, scoring, etc. of the covering 4A.

Figure 4:
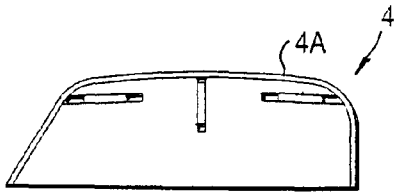
Figure 9:
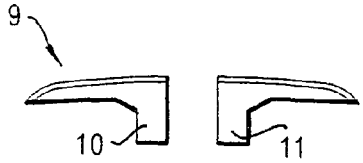
FIG. 9 depicts two end-moldings in accordance with the invention.

FIG. 4 shows structure 1 having a covering 4A thereon. In a preferred embodiment, covering 4A is a laminate formed from a thermosetting resin, having a décor sheet, optionally an overlay layer (with or without loose cellulosic fibers atop or therein) or sheet and hard particles in proximity thereto (e.g., in, on, above, or below, with or without a separate structure therebetween) in order to impart an abrasion resistance thereto, which is affixed to structure 1 in a high-pressure laminate process step. Such laminate may be affixed to structure 1 as described by U.S. Pat. No. 6,805,951, herein incorporated by reference in its entirety. Covering 4A can also be other finishing materials such as thermoplastic containing laminates, wood veneers, thermosetting polymers, such as vinyl or polyesters, thermoplastic polymers such as olefins, foils (such as thermosetting, thermoplastic, paper or metal foils), impregnated with or without hard particles, polyester, metals (such as sheets or single or strips), or combinations thereof. For example, covering 4A can include multiple elements, as described herein. It is additionally considered within the scope of the invention to affix covering 4A during a direct lamination step, as is known in the art.

Figure 5:
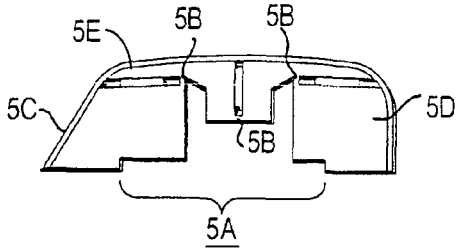
FIG. 5 is a side-view of a completed generic element in accordance with the invention.

Once covering 4A is applied, structure 1 can be shaped to form the generic molding 5 as to be sold. As shown in FIG. 5, generic molding 5 may have one more notches 5A disposed in under face 1E. Such notches may additionally include elements or structures as described by U.S. application Ser. No. 11/343,199, herein incorporated by reference in its entirety. Such shaping may be performed by manual or automated cutting, such as by severing, broaching, machining, routing, sawing, chipping, planing, sanding, or by any other method for removing material from the structure of structure 1. Of course, the method used to shape structure 1 is usually selected depending upon the material used for structure 1 and the desired shape for generic element 5. For example, if structure 1 were extruded or molded, it is possible to form structure 1 with the notches 5A therein, such that a separate shaping step is not necessary.

Typically, generic element 5 can be manipulated by a further shaping step to form more than one flooring molding. Thus, the configuration of generic element 5 depends upon the desired traditional flooring moldings potentially formed by manipulating generic element 5. Accordingly, FIG. 5 shows a typical generic element 5 in accordance with the invention.

As shown in FIG. 5, generic element 5 has a first removable section 5C and a second removable section 5D connected to a central section 5E at connections 5B. Connections 5B are typically ledges or other elements, which hold removable sections 5C and 5D to central section 5E. Although FIG. 5 shows connections 5B as being merely extensions of the material of core 1A, it is additionally within the scope of the invention to form connections 5B as frangible joints, friction joints, tongue-and-groove joints, compression joints, glue (or other adhesive), or any combination thereof, in order to maintain such connections 5B made without any physical connections because the cut goes all the way, relying, at least in part, on covering 4A to maintain structural integrity.

Due to the construction of generic element 5, including covering 4A and connections 5B, various flooring profiles or moldings can be formed. Removing removable sections 5C and 5D from generic element 5 can produce a T-molding 6, while removing only section 5C from generic element 5 can produce a carpet reducer 7, and removal of only section 5D from generic element 5 can produce a hard surface reducer 8. If core 1A is provided with a cut 2B in upper surface 1B, it is further possible to divide T-molding 6 to form two end moldings 10.

Figure 24:
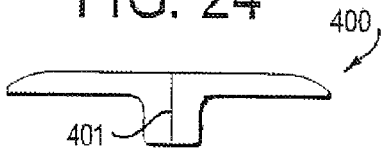
FIG. 24 is another T-molding with a break away feature.
Figure 25:
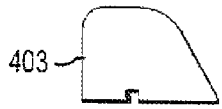
FIG. 25 is a reversible CR/HSR.
Figure 26:
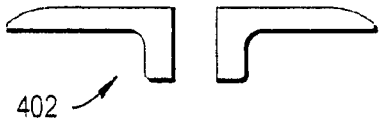
FIG. 26 shows two end moldings.
Figure 27:
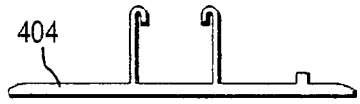
FIG. 27 shows a track which can be used with embodiments of the invention.
Figure 28:
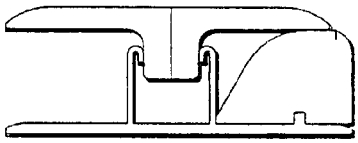
FIG. 28 represents an assembled and installed carpet reducer.
Figure 29:
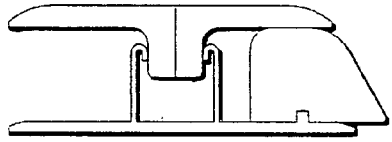
FIG. 29 represents an assembled and installed hard surface reducer.
Figure 30:
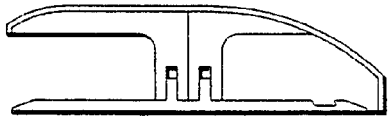
FIG. 30 shows a combination HSR/CR with two break away sections.
Figure 31:
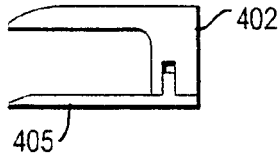
FIG. 31 is an end molding with a track after the track has been separated.
Figure 32:
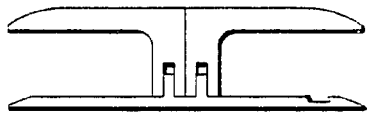
FIG. 32 shows another T-molding of the invention installed in its track.

Similarly, a generic molding can be manufactured having only two removable sections, such that in its original configuration, the generic molding is a T-molding 400 (FIG. 24), and when separated along breakaway 401, two end moldings 402 are produced (FIG. 26). This T-molding 400 can be used in combination with a reversible element 402 (FIG. 25) to form a HSR or CR (depending upon the orientation of reversible element 402), as described by U.S. application Ser. No. 11/066,099 and U.S. application Ser. No. 11/343,199, each of which is herein incorporated by reference in its entirety. The T-molding 400 and reversible element 402 can be used with a different track 404 to hold the resulting assembly in place (FIGS. 27-32). When the end molding 402 is to be used with a securing element, preferably an alternate track 405 is used (FIG. 31). The track 405 can be formed by cutting or breaking track 404 to match the latitudinal length of the end molding 402.

Another generic molding which can be used without manipulation is T-molding 501 (FIG. 38). This T-molding 501 has a number of removable sections 502, 503, and 504 (A and B), which can produce different shapes. For example, removal of sections 503 and 504B can produce a CR 501A (FIG. 39). Removal of section 504B only could produce a first modified T-molding 501B (FIG. 40), which can be used for shallow tile, vinyl or low carpet (e.g., Berber). Removal of sections 502, 503, 504A and 504B can produce a second modified T-molding 501C (FIG. 41) for higher floorings, such as tile and hardwoods and deeper carpets.

In other embodiments, it is possible to create other flooring profiles or transitions from generic molding 5. For example, removable section 5C or 5D can be shaped to form a traditional quarter-round molding when removed from section 5E. Additionally, generic element 5 may be shaped to form a traditional stair nose molding when one or both of removable sections 5C and 5D are separated. Thus, it is considered within the scope of the invention to shape generic molding 5 such that when separated, removable section 5C can be used as a quarter-round molding, while the remaining structure, i.e., section 5D joined to section 5E, can be used as a stair nose molding, as discussed below.

In one embodiment, covering 4A must be cut or severed in order to separate the removable sections. Such a process typically requires the use of a specialized tool, which divides covering 4A, e.g., with a blade or other cutting tool, along the respective cut 2. Once covering 4A has been subdivided, it becomes possible to separate any necessary removable sections. Typically, a great deal of force is required to break connection 5B, such that if the generic molding 5 were used with the removable section in place, the generic molding 5 would maintain its structural integrity, although in other embodiments, little or no force is required. The cutting tool or a second tool can be used to provide that force, for example, a standard flat-head screwdriver or other narrow width tool can be inserted into cut 2, either through the slot in severed covering 4A or from a longitudinal end of generic molding 5, and the removable section pried from the remainder of generic molding 5. Thereafter, the remaining part of generic molding 5 can be sanded to remove any burrs or other rough surfaces created during the prying. In one embodiment, the cutting, prying and sanding can all be performed by the same tool. Thus, it is possible to package one generic molding 5 along with the three-function tool.

Although it is preferred that breaking or separating connection 5B require the use of a tool, it is within the scope of the invention to have a weaker attachment. For example, connection 5B may be broken by human hand and arm pressure alone, i.e., without the use of any type of tool.

Because shim 3 is inserted into cut 2, separation of a removable section from generic molding 5 often will cause shim 3 to fall out. However, instead of simply discarding shim 3 as trash, shim 3 may be used as a shim to be utilized when installing any resulting molding, above or below any means for attaching the resulting molding, such as a track or clamp.

As covering 4A is preferably applied to core 1A in one piece, as is described by U.S. Pat. Nos. 6,517,935 and 6,898,911 (each of which is herein incorporated by reference in its entirety), covering 4A should not have any dividing lines or other demarcations marring the decorative surface.

Often, covering 4A is provided with a patterned paper sheet therein, wherein the pattern resembles a natural or synthetic object, such as wood, ceramic, stone (including marble and granite), or fantasy patterns (i.e., those not found in nature), including a monochromatic or random field. The specific generic molding 5 can be selected to enhance the appearance of the surfaces which will be adjacent to the generic molding 5 (or parts thereof) when installed. Such enhancement can be accomplished by matching exactly the visual pattern of generic molding 5 to that of the adjacent surface, or by contrasting the patterns, for example, such that when installed, a visual pattern extends from a flooring element onto and possible completely across the molding, as described by U.S. application Ser. No. 09/964,838, filed Sep. 28, 2001, herein incorporated by reference in its entirety. The resulting products typically have a durability rating. As defined by the European Producers of Laminate Flooring, such products can have a durability rating of anywhere from AC1 to AC5. Preferably, the products of this invention have a rating of either AC3 or AC5.

Moreover, it is possible to provide covering 4A with a textured upper surface which enhances the pattern of the underlying paper sheet. Such texturing can be created to be "in register" with, offset from, or to contrast with the image of the paper sheet. Such texturing may be created by physical pressing, e.g., embossing (as taught by U.S. application Ser. No. 10/440,317 (filed May 19, 2003), U.S. Pat. No. 7,003,364, WO9731775 and WO9731776, each of which is herein incorporated by reference in its entirety) or chemically created (as taught by U.S. Pat. No. 6,991,830, herein incorporated by reference in its entirety). The texture of the covering 4A can be selected by the installer to enhance (e.g., match or contrast with) any texture of adjacent surfaces.

It is additionally possible to provide removable sections 5C and 5D with opposite decorative surfaces (as disclosed by U.S. application Ser. No. 10/748,852, Ser. No. 11/066,099, and Ser. No. 11/343,199, each of which is herein incorporated by reference in its entirety), such that after being removed from generic molding 5, removable sections 5C and/or 5D can be re-attached in a reverse configuration to section 5E by, for example, tongue-and-groove joints, friction joints, or adhesive. By providing generic molding 5 with reversible structures, the number of functions of the single product can be greatly increased.

Figure 6:
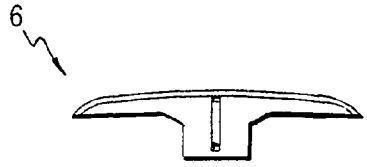
FIG. 6 is a side-view of a T-molding formed from the generic element of FIG. 5.
Figure 10:
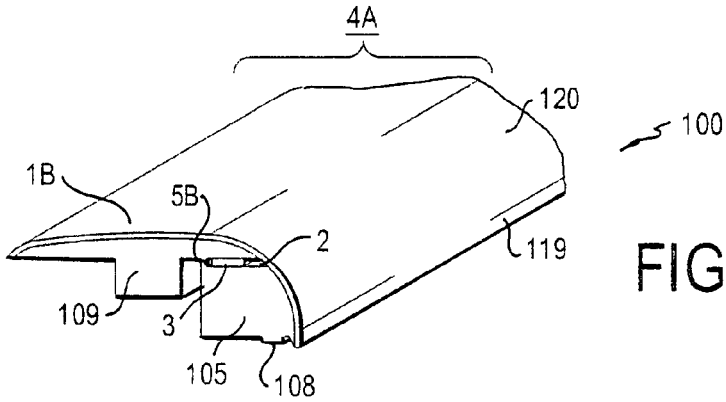
FIG. 10 shows a different carpet reducer/hard surface reducer in accordance with the invention.
Figure 11:
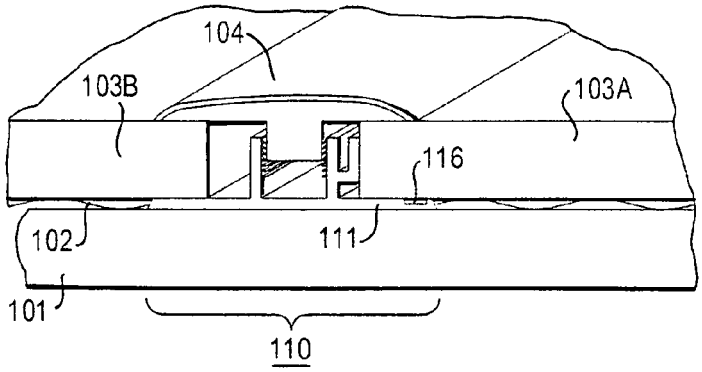
FIG. 11 represents a T-molding installed with the track of the invention.

FIG. 10 shows a different embodiment for a CR/HSR 100. When installed as a carpet reducer ("CR"), the end of the carpet adjacent CR/HSR 100 can be tucked or turn against a vertical face 119 of removable section 105. When used as a hard surface reducer ("HSR"), inclined surface 120 provides an angular surface that graduates the height differences between two flooring surfaces. A foot 109 is provided on CR/HSR 100 to allow for connection to track 110, as described below. Foot 109 is preferably formed from the same material as the remainder of CSR/HSR 100, but alternatively, may be formed from a different material through a different process and thereafter, joined to the remainder of CR/HSR 100. Similarly, foot 109 can be joined to the remainder of CR/HSR 100 by, for example, an additional connection 5B, such that, if desired, foot 109 can be removed. As with generic element 5 (FIG. 5), removable section 105 is preferably attached by a connection 5B, formed by the creation of a cut 2 (with or without a shim 3 placed therein), and can be removed from CR/HSR 100 to form a T-molding, such as shown in FIGS. 6 and 11. In a preferred embodiment, removable section 105 is provided with a tab 108 that can fit and rotate with a corresponding groove 116 in a securing element (described below).

In FIG. 11, removable section 105 has been removed to create a T/End molding 104. T/End molding 104 can be connected to a securing element 110, which securing element 110 is preferably not affixed to a sub-floor. Securing element 110 is, however, preferably affixed to one or both adjacent flooring elements 103A, 103B. This can be accomplished with a fresh adhesive, pre-glue, magnetically, or by any conventional mechanical device, such as a screw, nail, etc. Arms or extensions of T/End molding 104, as well as T molding 6, can overlap finished flooring approximately 0.25"-0.75" (approximately 6.5-20 mm), preferably approximately 0.5" (13 mm).

An underlayment 102 can be placed between flooring elements 103 and subfloor 101. Underlayment 102 can be any conventionally known underlayment, such as those used as moisture barriers and/or sound/shock/electric charge dampening, and can be affixed to flooring elements 103, or simply laid down before flooring elements are installed. It is additionally considered within the scope of the invention to utilize an underlayment which creates moisture channels below flooring elements 103, such as PLATON STOP and/or PLATON FLOOR, by Isola as of Norway.

As shown, T/End molding 104 overlaps the flooring elements 103A, 103B. This allows the T/End molding 104 to function, with sufficient space for expansion or contraction of flooring elements 103A and/or 103B without the need to anchor securing element 110 to the subfloor. Additionally, if the flooring elements 103A, 103B are not secured to the securing element 110, each of the flooring elements 103A could move independently of each other. It is also considered within the scope of the invention to affix securing element 110 to one of the flooring elements 103A, which would cause T/End molding 104 to move with flooring element 103A, while the other flooring element 103B would not be so constrained.

Figure 12:
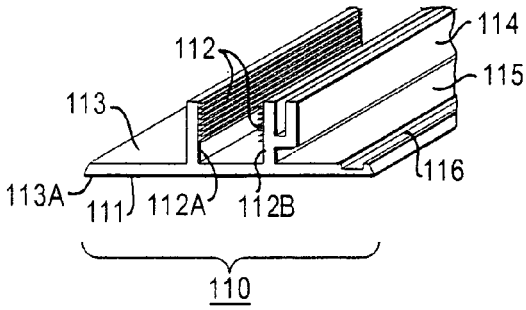
FIG. 12 is a view of the track used in FIG. 11.

A preferred securing element, or track 110 to be used with the moldings of the invention is shown in FIG. 12. Track 110 is preferably made of a plastic, metal or composite material, and can be used to secure any of the parts described herein to flooring elements 103A, 103B and/or a subfloor. Vertical portions 112 are shown as upstanding from base 111. Although shown as being perpendicular to base 111, vertical portions 112 can be at any angle therefrom. For example, while a first vertical portion 112A can be perpendicular to base 111, a second vertical portion can be disposed at any angle. In one preferred embodiment, vertical portions 112 are upstanding from base 111, but angle towards each other. As a result, vertical portions 112 are biased inwards, and the biasing assists in holding the molding in place.

First wing 113 is a portion of base 111 which is designed to be placed below a flooring element 103 (as shown in FIG. 11). A distal portion 113A of wing 113 can be folded back 1800 to form a shim, in order to raise track 110 or other parts to accommodate thicker flooring elements 103.

Disposed adjacent to, but preferably not in contact with, a vertical portion 112 is a second vertical portion 114. This second vertical portion helps to support, for example, removable section 105, by preventing back and forth movement. When removable section 105 is stepped on, rolled over, or otherwise subjected to forces tending to push it inwards, second vertical portion 114 acts to maintain removable section 105 in the correct location.

Track 110 can also have a second wing 115, which second wing 115 can include a pre-applied adhesive (e.g., an encapsulated glue as described by U.S. application Ser. No. 10/725,932 and Ser. No. 10/270,163, each of which is herein incorporated by reference in its entirety), adhesive tape, fresh adhesive or can have a mechanical or magnetic attachment (as described by U.S. application Ser. No. 10/747,261, herein incorporated by reference in its entirety) to affix track 110 to the underside of flooring elements 103 and/or the subfloor. Second wing 115 may also be provided with a groove 116, sized and shaped to receive tab 108, which helps to hold removable section 105 in place and, simultaneously, allows removable section 105 to rotate in adjustment as the height of flooring elements 103 increases. It is considered within the scope of the invention to swap the relative locations of the tab 108 and grove 116.

It is additionally possible to utilize a track having a single upstanding section, positioned between lower lateral ends (such as shown in FIG. 1A of both U.S. Published Patent Appl. No. 2003/0084634 and No. 2003/0154678—each of which is herein incorporated by reference in its entirety). Such a track can be inserted into a groove positioned in an underside of generic structure 5. In one embodiment, the foot, or middle lower depending portion of generic structure 5 can be reduced in size or eliminated, as the interaction between this track and groove can be sufficient to hold the structure in its installed condition. Additionally, an uppermost end of the track can be provided with barbs, spikes, projections, joint elements (such as tongue/groove) or other elements which can enable the track to lock or more securely hold the structure in its installed condition.

Figure 13:
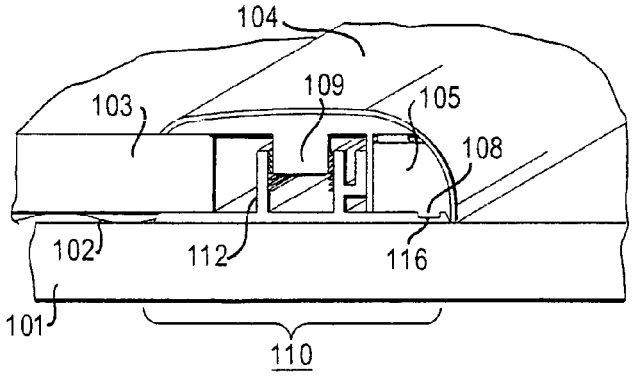
FIG. 13 represents an installation of the reducer of FIG. 10 using the track of FIG. 11.
Figure 20:
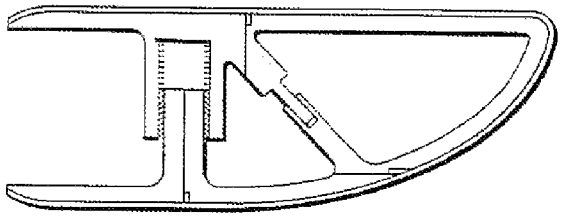
FIG. 20 shows a carpet transition formed from the combination of FIG. 19.
Figure 21:
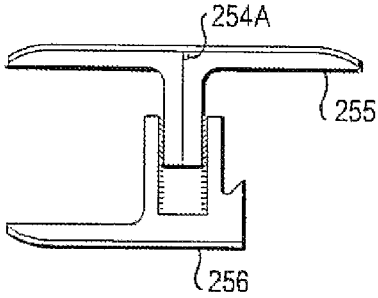
FIG. 21 shows a T-molding formed from the combination of FIG. 19.
Figure 22:
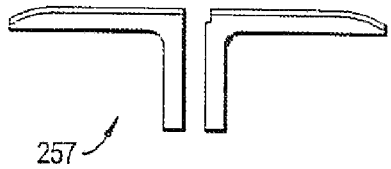
FIG. 22 shows end moldings formed from the combination of FIG. 19.

In FIGS. 13 and 14, T/End molding 104 is shown, in an installed condition, as a carpet/hard surface reducer (with removable section 105) and an end molding (without removable section 105), respectively. As can be seen, foot 109 of T/End molding 104 is secured in track 110 by vertical sections 112. Track 110 is secured to a subfloor 101 with an adhesive, magnetic forces or mechanical attachments. In FIG. 14, T/End molding 104 is installed adjacent a wall 118. A sealant or adhesive 117 may be placed in any gaps between T/End molding 104 and another structure, such as a wall 118. As shown in FIG. 14, T/End molding 104 can be used without any securing element, as the presence of adhesive 117, may be sufficient to maintain T/End molding 104 in place. Such sealant or adhesive can be a fresh glue or a pre-applied glue (e.g., a "preglue" applied at the factory). In a preferred embodiment, adhesive 117 is a foaming adhesive, e.g., a silicone sealant or alternate foaming adhesive, such that after adhesive 117 and T/End molding 104 are installed, adhesive 117 foams or expands to fills voids between wall 118 and T/End molding 104.

FIGS. 15-22 depict an additional molding assembly of the invention. This extrudable assembly 202 is preferably formed from an extrudable polymeric, composite or metal material, but may also include or be substituted by milled composite materials, wood, fiberboard, or any other material discussed herein suitable for core 1A.

Typically, assembly has a decorative outer surface 201, which surface 201 is preferably selected from the same materials for the outer faces of structure 1.

As shown, assembly 200 can be constructed with a combination HSR/CR 202 and a T-molding 204 (which need not be of the same material), joined at breakaways 204. Breakaways 204 can be narrowed or scored or other sections of assembly 202, allowing for separation of the parts of assembly 200. Breakaways 204 can also be joints between two separate elements, formed by, for example, friction joints, tongue-and-groove joints, compression joints, glue, or any combination thereof.

Assembly 200 can be fixed to a subfloor using any material described herein, such as adhesive (e.g., pre-applied or fresh glue), tape or magnetic strip (optionally with tape or adhesive). Installing assembly 200 in a first configuration produces a HSR, while inverting assembly 200 produces a CR (FIG. 18).

By providing one set of legs 208 on assembly 200, assembly 200 can be used in a variety of configurations. As can be seen in FIG. 15, applying force to push or pull the sections of assembly 200, different shapes, to accommodate different flooring heights. Desired positions for legs 208 can be selected and locked in place by utilizing a glue, sealant, epoxy, or other chemical element, or in the alternative (or in combination with), barbs or teeth 212.

By splitting or breaking assembly 200 at breakaways 206, different moldings can be realized. Another T-molding 220 is created by separating assembly 200 at each of breakaways 206B and 206C. This T-molding 220 is preferably joined to one flooring element with an adhesive 222, which can take the form of any glue or adhesive described herein, but preferably is a peel-and-stick adhesive, and is positioned to join to both an upper surface and a lower surface of the flooring element. Such a construction, similar to other embodiments, allows T-molding 220 to "float" with the joined flooring element, independent of other flooring elements. In another embodiment, T-molding 220 can be affixed to the subfloor with any glue, adhesive or magnetic means (discussed herein), alone or in combination with affixing to the flooring element.

If assembly 200 is split or separated at breakaways 206A and 206C, an end molding 230 can be produced (FIG. 17). The end molding 230 can be affixed to the upper surface of an adjacent flooring element, or if used in combination with a track 232, both the track 232 can be joined to either the subfloor or the underside of the adjacent flooring element, alone, or in combination with the end molding 230 being affixed to the flooring element. If the end molding 230 is used without the track 232, a lower end of end molding 230 can also be affixed to the subfloor.

An alternate embodiment of the assembly 200 shown in FIG. 15 is an additional assembly 250 (FIGS. 19 and 20), which can also function as a HSR or CR, depending upon its installed orientation. This assembly 250 has a supporting strut 252 that is adjustable and can move when adjustable legs 253 are raised/lowered for different finished flooring thicknesses. The adjustable strut 252 provides additional strength to the structure of the assembly 250. In order to prevent strut from moving once installed, it is considered within the scope of the invention to provide a locking mechanism, such as barbs, glues/adhesives, or other means for maintaining the strut 252 in its desired configuration. Just as the assembly 200 can be separated at various breakaways, the assembly 250 can be broken at breakaways 254A-C for form various products. A T-molding 256, and its optional associated track 256 (FIG. 21), can be formed by separating assembly 250 at breakaways 254B and C. Two end moldings 257 (FIG. 22) can be produced by separating assembly 250 at breakaways 254A, B and C.

Figure 23:
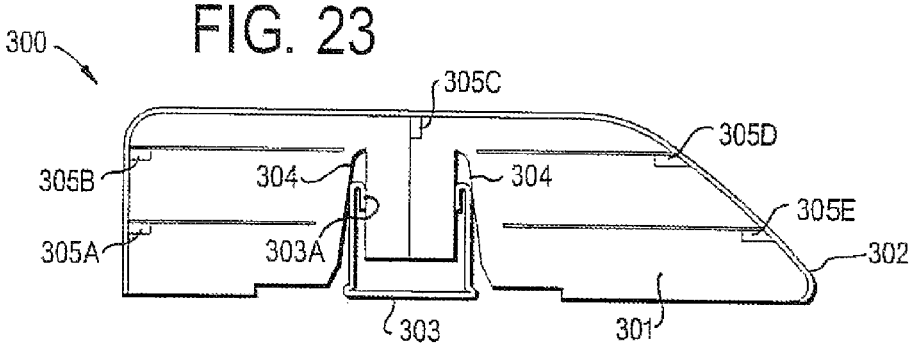
FIG. 23 represents an additional break away molding of the invention.

Another embodiment of the generic molding of the invention is shown as generic molding 300 (FIG. 23). The generic molding 300 is a breakaway version with multiple horizontal sections for forming a versatile molding capable of being used for a large range of finished flooring thicknesses. This version can be an extrusion or other milled or shaped material such as HDF, MDF, composites, metal, wood or plastic. A core 301 of the generic molding 300 can also be manufactured from any structural material discussed herein in connection with other embodiments of the invention. Similarly, a finished surface material 302 covers at least a portion of the core 301 and preferably provides the generic molding 300 with a decorative outer surface, and may be any type of decorative surface discussed elsewhere herein. When in a desired configuration, the generic molding 300 is preferably installed with a track 303, which track can include one or more gripping flanges 303A which can interact with one or more gripping grooves 303B (not shown) to help to maintain the generic molding in place. In a preferred embodiment, the generic molding 300 is provided with rounded shoulders 304, formed as part of the core 301 or as an additional structure, which bears against legs of the track 303 to add support to each of the sections holding the generic molding 300 in place.

In order to use the generic molding 300 in various configurations, the generic molding 300 is typically provided with breakaways 305A-D, to independently reduce the height of the core 301 of the generic molding 300 to form a T molding, end molding, CR or HSR as discussed herein, for a number of heights. Although shown with a particular number of removable sections on each side of the generic molding 300, it is considered within the scope of the invention to increase or decrease the number, size and shape of the sections, such that, for example, the number of sections on one side is unequal to the number of sections on the other side.

Figure 33A:
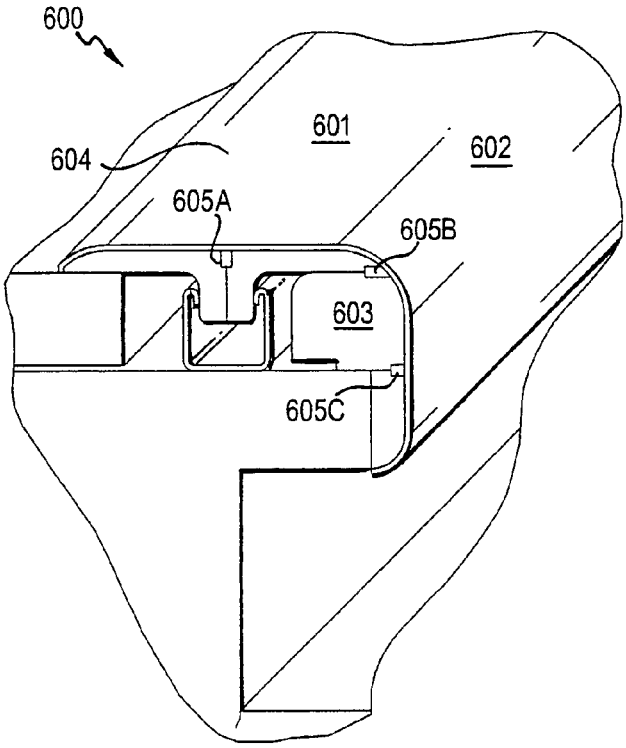
FIGS. 33 and 34 depict a stair nose attachment of the invention.
Figure 34:
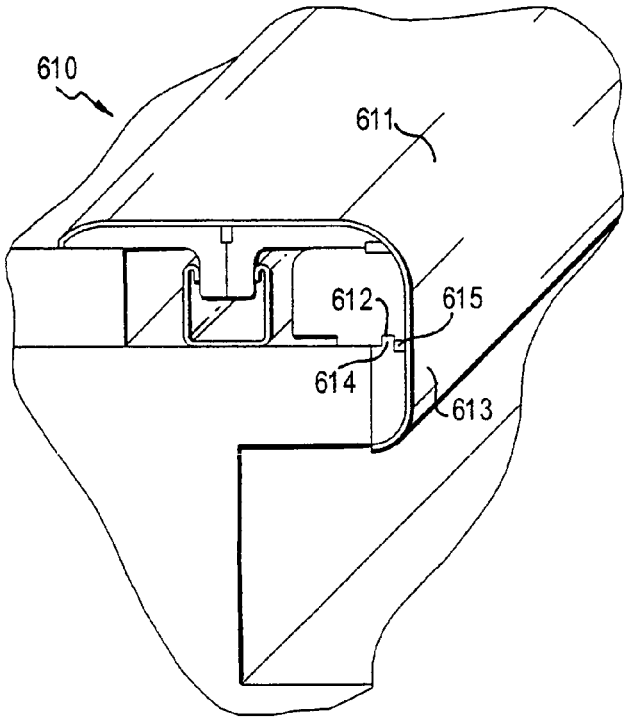

The invention additionally includes a stair nose assembly 600 (FIGS. 33A and 34). In a first embodiment, the stair nose assembly 600 can be formed by joining a T molding (such as T-molding 6, 220, 255, 400, or T/End molding 104) with a structure (such as end moldings 10 and 230). The joint formed at the junction between the T-molding and the additional structure can be maintained by any means discussed herein, such as adhesive/glue or other chemical or mechanical element. By forming the elements of stair nose assembly 600 with matching décor, a uniform appearance can be achieved.

Figure 33B:
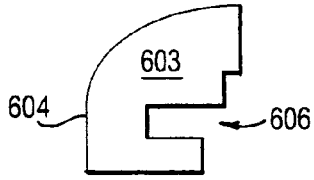

Preferably, however, stair nose assembly 600 is a unitary structure, sold as a single unit, consisting of a first section 601, and a second section 602, manufactured as a single structure. Typically, the stair nose assembly 600 includes a core 603 and a covering 604, which are selected from the cores and covering materials discussed elsewhere herein. In one embodiment, the stair nose assembly 600 is provided with cuts 605A-C which permit the stair nose assembly 600 to be used for other purposes after being separated at cuts 605A-C. For example, dividing at cut 605A produces an end molding 10, while dividing at cut 605B produces both an end molding 10 and a T-molding 6. Dividing at cut 605A and 605C can produce an element which can be used as a quarter round or shoe molding 606 (FIG. 33B).

An alternate stair nose assembly 610 can be formed by forming a carpet reducer 611, substantially similar to the carpet reducer 7, having a groove 612 in a lower surface thereof. By joining a stair nose attachment 613, by inserting a tongue 614 thereof into the groove 612, the stair nose assembly 610 can be formed. Similarly, stair nose assembly can be manufactured as a single piece by joining the carpet reducer 611 to stair nose attachment prior to adding the decorative surface thereof, or by forming the stair nose assembly 610 as a unitary structure, allowing for removal of stair nose attachment 613 at installation, at, for example, cut 615. When removed, stair nose attachment 613 can be used as a shoe molding or quarter round molding.

Each of the stair nose assemblies 600 and 610 can be affixed directly to the subfloor with a mechanical, chemical or other attachment means as discussed herein. Alternatively, a track may be used to secure the stair nose assemblies 600 and 610.

One preferred method for forming a generic molding element 650 is shown in FIGS. 35-37. By this method, individual pieces are separately manufactured and held together in place by the covering material. In a first step, two end moldings 650A and 650B, a carpet reducer part 605C and a hard surface reducer part 605D are milled or otherwise shaped from a core material (as disclosed herein) and held together (FIG. 36).

This can be accomplished by, for example, using a clamp, other mechanical elements or a glue (sufficient to hold the pieces together until the covering is applied). Once the pieces are held together cuts 611-613 can be made, and thereafter, a covering 654 (as discussed herein) is applied. Through this method, the covering 654 (and optionally the glue) holds the generic molding element 650 together.

The molding of the invention can be produced by forming the generic structure, and providing cuts therein, before affixing the covering thereto. In one embodiment, the separable parts are completely removed from each other and can be held in place by a clamp or a mold, until the covering is affixed thereto.

In another embodiment, the covering can be affixed to the generic structure prior to the separable elements being formed. Typically, the cuts are formed in the underside of the structure, as the upper surface of the generic structure has the covering thereon.

It should be apparent that embodiments other than those specifically described above may come within the spirit and scope of the present invention. Hence, the present invention is not limited by the above description.

We claim:

1. A kit comprising:

a first molding element comprising an upper section having an exposed surface and a foot depending therefrom; and a second molding element comprising:

an upper surface, capable of being joined to the first molding element;

a lower surface having a spacing gap therein; and at least two lateral surfaces; and a track; the track comprising at least one upstanding protrusion, the protrusion sized and shaped so as to fit into the spacing gap, the track extending beyond the upstanding protrusion.

2. The kit of claim 1, wherein the second molding element is sized and shaped to form a molding selected from the group consisting of a transition molding, a hard surface reducer, a carpet reducer, a wall base molding, a stair nose, and a quarter round molding when joined in a first orientation to first molding element and a second, different, molding selected from the group consisting of a transition molding, a hard surface reducer, a carpet reducer, a wall base molding, a stair nose, and a quarter round molding when joined to the first molding element in a second orientation.

3. A joint cover assembly for covering a gap between two floor elements covering a subsurface, the assembly comprising:

a first molding element comprising an upper section having an exposed surface and a foot depending therefrom; and a second molding element comprising:

an upper surface, joined to the first molding element;

a lower surface having at least one spacing gap therein; and at least two lateral surfaces; and, a track, the track comprising at least one upstanding protrusion the protrusion sized and shaped so as to fit into the at least one spacing gap, the track extending beyond the upstanding protrusion and at least partially beneath the second molding element.

4. The joint cover assembly of claim 3, wherein the joint cover assembly is one molding selected from the group consisting of a transition molding, a hard surface reducer, a carpet reducer, a wall base molding, and a quarter round molding.

5. The joint cover assembly of claim 3, wherein the track extends beneath the entire second molding element.

6. The joint cover assembly of claim 3, wherein an adhesive is utilized between the upper surface and the first molding element.

7. The joint cover assembly of claim 3, wherein an outer surface of the second molding element is substantially vertical and an opposed surface of the second molding element tapers upwardly towards the first molding element.

* * * * *